US007717166B2

(12) United States Patent
Buchanan

(10) Patent No.: US 7,717,166 B2
(45) Date of Patent: May 18, 2010

(54) FIN STOCK FOR A HEAT EXCHANGER AND A HEAT EXCHANGER

(75) Inventor: Robert C. Buchanan, Branford, CT (US)

(73) Assignee: United Aluminum Corporation, North Haven, CT (US)

( * ) Notice: Subject to any disclaimer, the term of this patent is extended or adjusted under 35 U.S.C. 154(b) by 0 days.

(21) Appl. No.: 11/134,134

(22) Filed: May 20, 2005

(65) Prior Publication Data

US 2005/0257924 A1 Nov. 24, 2005

Related U.S. Application Data

(60) Provisional application No. 60/573,646, filed on May 21, 2004.

(51) Int. Cl.
*F28F 13/18* (2006.01)

(52) U.S. Cl. ..... 165/184; 148/437

(58) Field of Classification Search ..... 148/437; 165/184

See application file for complete search history.

(56) References Cited

U.S. PATENT DOCUMENTS

| | | | | |
|---|---|---|---|---|
| 6,173,763 | B1 | 1/2001 | Sano et al. | 165/133 |
| 6,192,976 | B1 | 2/2001 | Yoshida et al. | 165/171 |
| 6,419,009 | B1 | 7/2002 | Gregory | 165/151 |
| 6,585,034 | B2 | 7/2003 | Oswald | 165/10 |
| 6,607,027 | B2 | 8/2003 | Bosch et al. | 165/163 |
| 6,789,611 | B1 | 9/2004 | Li | 165/104 |
| 6,808,570 | B2 | 10/2004 | Mitsuhashi | 148/429 |
| 6,820,682 | B2 | 11/2004 | Hayashi et al. | 165/52 |
| 6,840,312 | B1 | 1/2005 | Sandberg | 165/152 |
| 6,857,469 | B2 | 2/2005 | Meller et al. | 165/175 |
| 6,889,757 | B2 | 5/2005 | Iwasaki et al. | 165/135 |
| 6,889,758 | B2 | 5/2005 | Burgers et al. | 165/148 |
| 6,889,759 | B2 | 5/2005 | Derosier | 165/151 |
| 2005/0034793 | A1 * | 2/2005 | Henry et al. | 148/551 |

FOREIGN PATENT DOCUMENTS

JP 59082115 A * 5/1984

OTHER PUBLICATIONS

'ASM vol. 4 Heat Treating', ASM International, 1991, p. 876-877.*
'Aluminum and Aluminum Alloys', ASM International, 1993, p. 71, 646-647.*
"Aluminum and Aluminum Alloys", ASM International, 1993, p. 60.*
"ASM Handbooks: vol. 8 Mechanical Testing and Evaluation", ASM International, 2003, p. 1-14. http://products.asminternational.org/hbk/index.jsp.*

* cited by examiner

*Primary Examiner*—Roy King
*Assistant Examiner*—Janelle Morillo
(74) *Attorney, Agent, or Firm*—St. Onge Steward Johnston & Reens, LLC

(57) ABSTRACT

The invention relates to a fin stock material having aluminum, where the material also has a tensile strength of between approximately 14,000 and approximately 26,000 psi, an elongation of less than 30%, and a hardness of between approximately 50 and approximately 70 on a Rockwell 15T scale.

12 Claims, 4 Drawing Sheets

FIN STOCK FOR A HEAT EXCHANGER AND A HEAT EXCHANGER

RELATED APPLICATION

This application claims priority benefits under 35 U.S.C. §119(e) of U.S. Provisional Patent Application Ser. No. 60/573,646 filed May 21, 2004.

FIELD OF THE INVENTION

The invention relates to a heat exchanger with stronger fins that facilitate heat transfer.

BACKGROUND OF THE INVENTION

A heat exchanger typically has a metal tube with fins extending radially away from the metal tube to increase the surface area which facilitates heat transfer. These fins are often called spiral fins and include a narrow aluminum strip that is helically wound to the metal tube, preferably the edge of the strip is secured to the tube. See FIG. 1 for a heat exchanger 10 in accordance with the prior art. FIG. 1 shows tube 12, fin 14, and edge 16 of fin secured to tube 12. The strip is usually fixed to the tube either by inserting it into a scored groove or by forming a small L at the base of the fin, which is then secured to the tube. See FIG. 2.

Because the fin is often bent about the tube to form the fin, particularly a fin having a rectangular cross section, it has commonly been believed that there is a large compressive force at the base of the fin and a large tensile force at the tip of the fin. This may be the rationale for traditionally manufactured fins to utilize a malleable material so that it may be formed and bent about a tube. Moreover, traditionally manufactured fins typically used a thermally conductive material so that it may be able to transfer heat.

Further, traditional methods for providing a fin often included the use of a stretchable material, the higher the ductility or elongation percentage the better. Hence, a fully annealed aluminum was normally used to provide fins. Additionally, the fully annealed aluminum often has at least a 30% elongation, a characteristic of the aluminum commonly specified within the spiral fin heat exchanger industry. Generally, aluminum of at least 99.00% purity is used for spiral fins because this offers enhanced thermal conductivity. 99% purity means the alloy has a minimum of at least 99% aluminum.

As a result, traditional fins, although having enhanced thermal conductivity, have been extremely soft and prone to damage during manufacture, handling, installation, and maintenance of the finned tubes. During servicing, fins are commonly cleaned using high-pressure air or water and the fins may bend as a result of the cleaning, in which case the fins may need to be repaired. The repair costs and down time often exacerbates the problem, especially when the repairs are needed each time the fins are cleaned. In the alternative, some users do not clean or repair the fins. However, debris on the fins or using distorted fins may reduce the heat-transfer capacity of the heat exchanger, and reduce the life of the fins or heat exchanger.

What is desired, therefore, is a fin that maintains the benefits of the traditionally made fins while reducing the disadvantages of the traditionally made fins. Another desire is a fin that resists distortion without a decrease in thermal conductivity. A further desire is a fin that resists damage without sacrificing needed flexibility to be maneuvered about the tube.

SUMMARY OF THE INVENTION

It is, therefore, an object of the invention to provide a fin with a material that is sufficiently malleable yet strong enough to resist distortion.

Another object is to provide a fin that is strong yet flexible enough to bend about a tube of a heat exchanger.

These and other objects of the invention are achieved by a fin stock having a material with aluminum, where the material also has a tensile strength of between approximately 14,000 and approximately 26,000 psi, an elongation of less than 30%, and a hardness of between approximately 50 and approximately 70 on a Rockwell 15T scale.

In some embodiments, the fin stock has a tensile strength between approximately 17,000 psi and approximately 24,000 psi with a yield strength of between approximately 17,000 psi and approximately 25,000 psi. In other embodiments, the fin stock has a tensile strength between approximately 3000 psi and approximately 6000 psi greater than fully annealed aluminum.

In further embodiments, the fin stock has an elongation less than approximately 20%. In some of these embodiments, the elongation is between approximately 1% and approximately 2%.

The fin stock is cold worked to achieve the above enhanced strength and hardness. As a result of the cold working, the material has a thickness of between approximately 0.014 gauge and approximately 0.020 gauge.

In another aspect of the invention, a method provides the fin stock. The method includes the steps of providing a material having aluminum, increasing a tensile strength of the material to between approximately 14,000 psi and approximately 26,000 psi, reducing an elongation of the material to less than 30%, and hardening the material to a hardness of between approximately 50 and approximately 70 on a Rockwell 15T scale.

In some embodiments, the method further includes the step of cold working the material to increase the tensile strength. In some of these embodiments, the method includes increasing the tensile strength of the material to between approximately 17,000 psi and approximately 24,000 psi without annealing the material.

As a result of increased tensile strength, the method reduces the elongation of the material to less than 20%. In further embodiments, the elongation is reduced to between approximately 1% and approximately 2%.

The method may further include reducing a thickness of the material to between approximately 0.014 gauge and approximately 0.020 gauge and increasing a yield strength of the material to between approximately 17,000 psi and approximately 25,000 psi.

In another aspect of the invention, a heat exchanger is provided and includes a tube for transporting a fluid, such as a liquid or gas or other medium or device that transfers heat. The heat exchanger also has a fin stock in contact with the tube for dispersing the temperature of the liquid or gas, where the fin stock contains aluminum. The fin stock has a tensile strength of between approximately 14,000 and approximately 26,000 psi, an elongation of less than 30%, and a hardness of between approximately 50 and approximately 70 on a Rockwell 15T scale.

In some embodiments, the fin stock is cold worked without annealing. In further embodiments, the tensile strength is between approximately 17,000 psi and approximately 24,000 psi and the elongation is between approximately 1% and approximately 2%. In other embodiments, the fin stock has a yield strength of between approximately 17,000 psi and approximately 25,000 psi.

DETAILED DESCRIPTION

Figure 3:
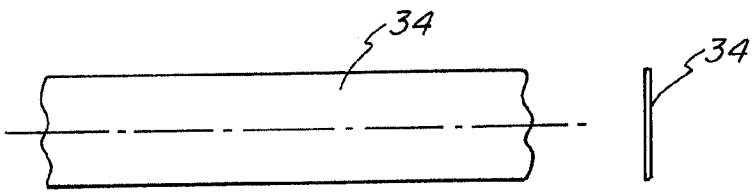
FIG. 3 depicts the fin stock in accordance with the invention.

As shown in FIG. 3, fin stock for use with a heat exchanger includes material 34 of aluminum that is cold worked. Cold working material 34 increases the strength of material 34 more than if material 34 was not cold worked or if material 34 was annealed, which is traditionally done to soften material 34 and, therefore, make material 34 more flexible at the expense of making material 34 weaker.

Material 34 is any aluminum alloy used for fin stock in heat exchangers, including 99% aluminum alloys (minimum amount of aluminum is 99%) such as 1100 and 1050.99% purity aluminum alloys are generally desired because of their thermal conductivity capabilities. In other embodiments, material 34 is aluminum alloy with manganese or magnesium, such as 5005 (which contains 0.50-1.1% magnesium). The manganese or magnesium often enhances strength and corrosion resistance. In further embodiments, material 34 is any aluminum alloyed with other elements. All of these aluminum alloys, whether having 99% purity aluminum or not, have higher tensile strengths from being cold worked. Material 34 includes all alloys that might be rolled to temper (full hard) or partially annealed to temper (half hard). Both full hard and half hard materials are described below.

Figure 4B:
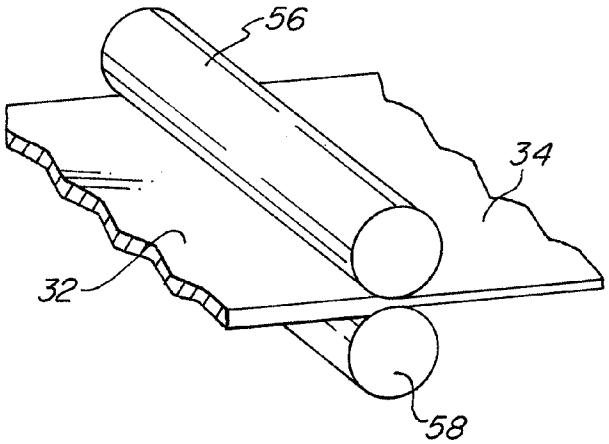
FIGS. 4*a* and 4*b* depict the fin stock being produced in accordance with the invention shown in FIG. 3.
Figure 4A:
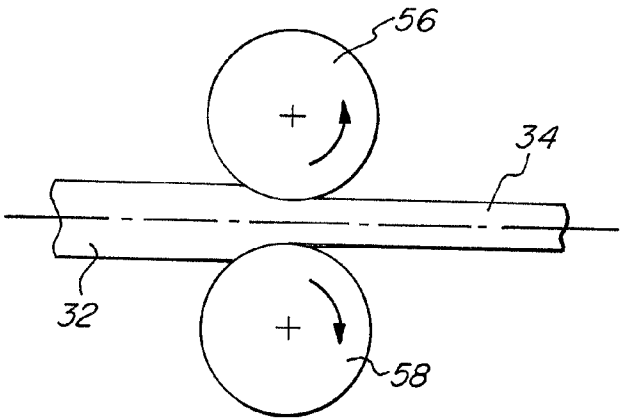

Cold working is defined as rolling, or squeezing, material 34 through at least two rollers (see FIGS. 4*a* and 4*b*) where material 34 that exits the rollers 56, 58 are stronger and thinner as a result of being rolled. Cold working is performed on material 34 without raising or negligibly raising the temperature of material 34. By cold working material 34, material 34 has a higher tensile strength, yield strength, and lower elongation than material 32 that has not been cold worked, which is located prior to rollers 56, 58. Another term that is interchangeable with cold working is strain hardening.

In some embodiments, cold working involves other manners for introducing stress on material 32, such as bending, striking, or physically altering a shape of material 32. The introduced stress remains with material 34 and renders material 34 stronger than material 32.

Material 34 exiting rollers 56, 58 have a thickness of between approximately 0.014 gauge to approximately 0.020 gauge and preferably between approximately 0.014 gauge to approximately 0.017 gauge. The above thicknesses are for material 34 with an elongation of less than 30%.

The grain structure of cold worked material 34 is non-recrystallized and may be coarse or fine, terms having their customary meaning as defined in the industry.

Figure 1:
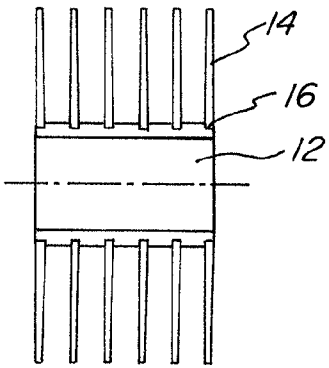
FIG. 1 (PRIOR ART)
FIG. 1 depicts a heat exchanger in accordance with the prior art.
Figure 2:
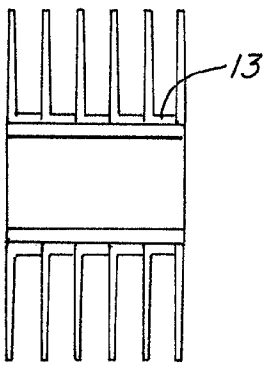
FIG. 2 (PRIOR ART)
FIG. 2 depicts another heat exchanger in accordance with the prior art.

The act of annealing releases the resulting stress from cold working and essentially reverses the act of cold working. As a result, annealed materials are less strong but more flexible than materials that are cold worked. Although annealed materials are traditionally preferred for the fin stock shown in FIGS. 1 and 2, because the annealed materials were softened and were often believed to be better suited for bending about tube 12. However, material 34 that is cold worked is sufficiently flexible to be formed about tube 12. Therefore, material 34 that has been cold worked results in a stronger fin 14 because material 34 is stronger than annealed materials or materials 32 that are neither annealed nor cold worked.

Traditional materials for fin stock were usually in a fully annealed condition in order to meet the requirements for a material with high elongation, defined to be generally greater than 30%. Materials with high elongation were believed to bend about tube 12 (see FIG. 1) more easily than harder materials. Therefore, flexibility was often the focus rather than strength. However, the requirement for a material with high elongation was flawed because material 34, which has a low elongation (less than 30%) and higher tensile strength than the traditional fully annealed material, proved to be both bendable about tube 12 and resist damage due to its higher strength.

The tensile strength of fully annealed aluminum alloy is between approximately 11,000 psi and approximately 14,000 psi. The yield strength of fully annealed aluminum alloy is approximately 5,000 psi.

Moreover, material 34 may be used to replace fins on heat exchangers that use the traditional fully annealed material because material 34 has many of the same chemical properties and thermal conductivity capabilities as fully annealed materials except material 34 has been cold worked, which does not vary the chemical composition or significantly vary the thermal conductivity of material 34.

As a result, fin stock with a high elongation is not a prerequisite and that cold-worked aluminum, with elongation levels below 20% and as low as 1-2%, can be rolled into a satisfactory helix with minimal adjustments to the manufacturing machine.

A range of tensile strengths for material 34 is between approximately 14,000 psi and approximately 26,000 psi. A preferred range of tensile strengths for material 34 is between approximately 17,000 psi and approximately 24,000 psi. A more preferred range of tensile strengths for material 34 is between approximately 18,000 psi and approximately 20,000 psi.

The tensile strength of material 34 is between approximately 3000 psi and 6000 psi stronger than fully annealed material, or 0 temper.

A range of yield strengths for material 34 is between approximately 10,000 psi and approximately 25,000 psi. A preferred range of yield strengths for material 34 is between approximately 15,000 psi and approximately 22,000 psi. A more preferred range of yield strengths for material 34 is between approximately 17,000 psi and approximately 20,000 psi.

As a result of the stronger tensile strength of material 34, elongation of material 34 is typically less than 30%. In some embodiments, the elongation of material 34 is typically less than approximately 20%. In further embodiments, the elongation of material 34 is typically less than approximately 5%. A preferred elongation of material is between approximately 0% and approximately 25%. A more preferred elongation of material is between approximately 0% and approximately 10%. A most preferred elongation of material is between approximately 1% and approximately 2%.

Elongation is defined to be the amount a material will stretch per a 2 inch length of that material until the material yields, or fails to return to the original state before stretching commenced.

The hardness of material 34 measured on a Rockwell 15T scale is between approximately 50 and approximately 70. The hardness of material 34 measured on a Rockwell 15T scale is preferably between approximately 55 and approximately 66. The hardness of material 34 measured on a Rockwell 15T scale is more preferably between approximately 60 and approximately 65.

In addition to winding, or bending, material 34 about tube 12 to form a helically wound fin, material 34 may be used as a fin in other heat exchangers that utilize any shaped fin, including a flat fin. Moreover, although a spiral fin is shown in the figures, any type of heat exchanger or air conditioner that uses fins can benefit from this invention.

It is understood that material 34 is cold worked to meet specific requirements of fin stock by a customer. Some customers require the highest tensile strength possible with fin stock without concern for elongation, in which case material 32 is simply cold worked. Other customers require a tensile strength and elongation somewhere in between a fully annealed material and a fully hard material (described in the immediately preceding sentence), in which case a half hard or partially annealed material would be provided. A partially annealed fin stock material 34 is where material 32 is partially annealed to soften it and then cold worked. Fully annealed materials are too soft to be cold worked.

It is understood that the limitations and ranges for tensile strengths, yield strengths, elongations, and other properties of partially annealed materials and materials without any annealing are collectively described above.

Figure 5:
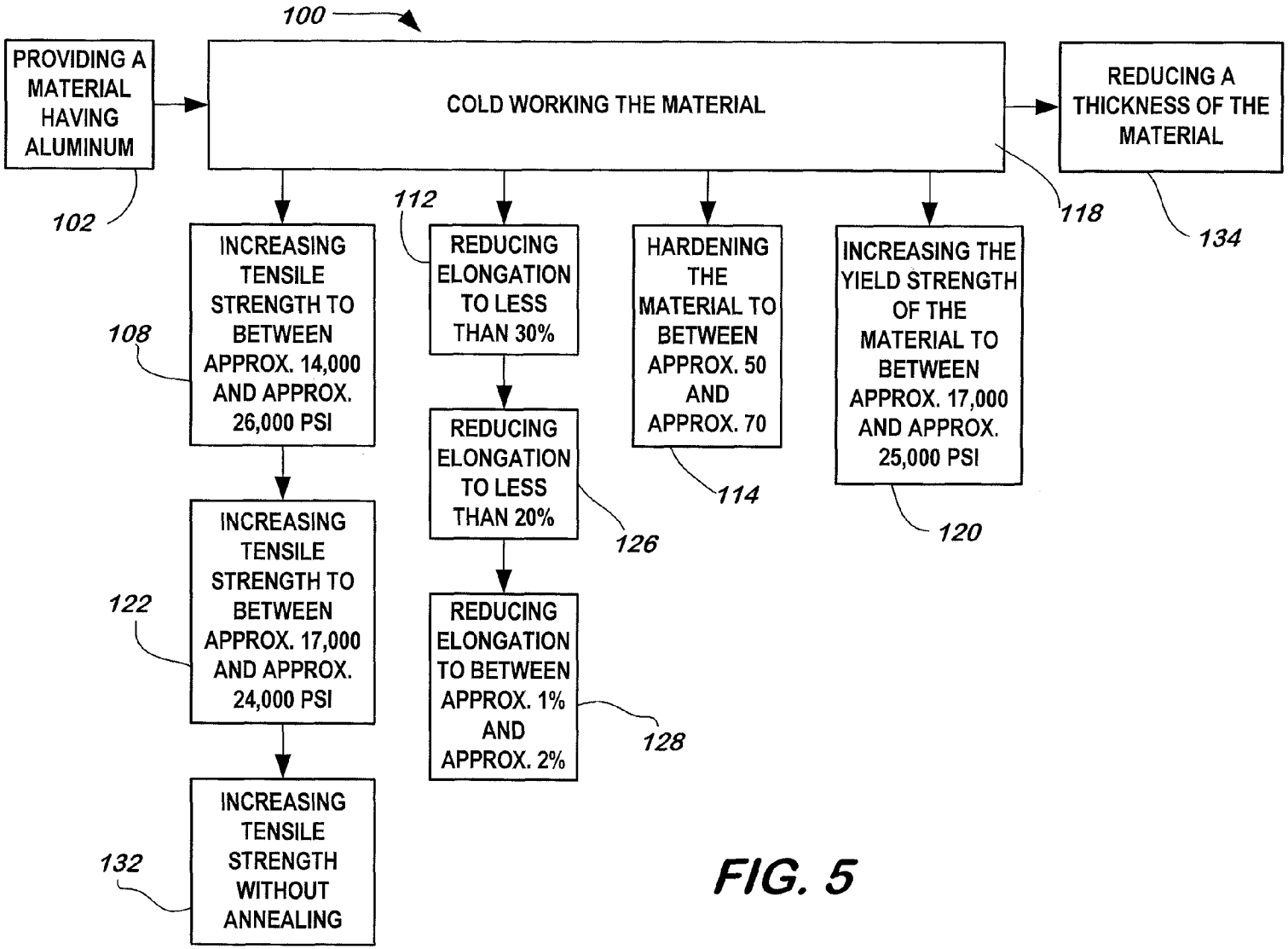
FIG. 5 depicts a method for providing the fin stock shown in FIG. 3.

FIG. 5 shows method 100 for providing the fin stock material 34 described above. Method 100 includes the steps of providing 102 a material having aluminum, increasing 108 a tensile strength of the material to between approximately 14,000 psi and approximately 26,000 psi, reducing 112 an elongation of the material to less than 30%, and hardening 114 the material to a hardness of between approximately 50 and approximately 70 on a Rockwell 15T scale.

Method 100 further includes the step of cold working 118 the material to increase the tensile strength and yield strength. In some embodiments, method 100 increases 120 the yield strength to between approximately 17,000 psi and approximately 25,000 psi. In other embodiments, method 100 increases 132 the tensile strength of the material without annealing.

In further embodiments, method 100 increases 122 the tensile strength of the material to between approximately 17,000 psi and approximately 24,000 psi and reduces 126 the elongation to less than 20%. In some of these embodiments, method 100 reduces 128 the elongation to between approximately 1% and approximately 2%.

In yet other embodiments, method 100 reduces 134 a thickness of the material to between approximately 0.014 gauge and approximately 0.020 gauge.

Figure 6:
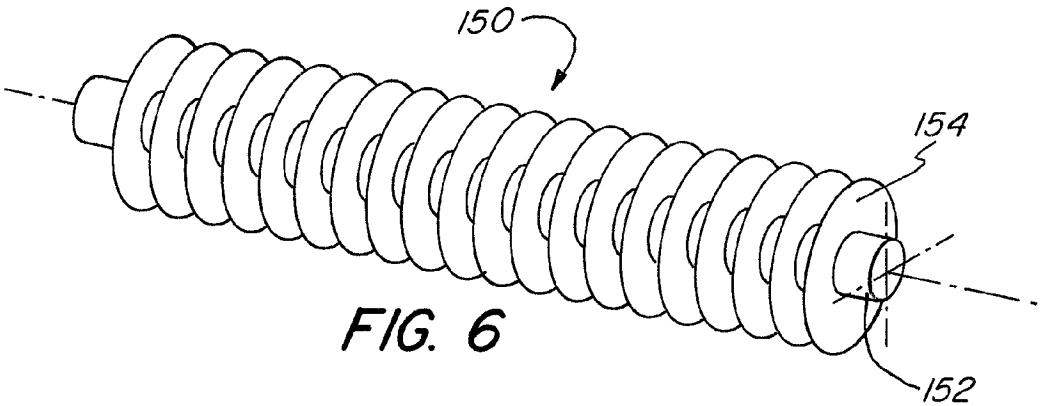
FIG. 6 depicts the fin stock shown in FIG. 3 as applied to a heat exchanger.

FIG. 6 depicts heat exchanger 150, where heat exchanger 150 includes tube 152 for transporting a gas or liquid and fin stock 154, where fin stock 154 includes material 34.

Figure 7:
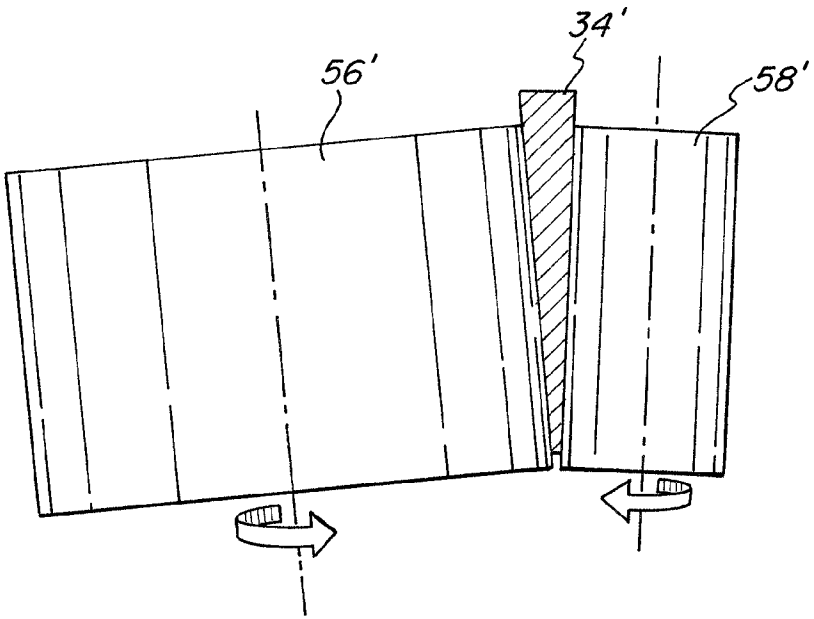
FIG. 7 depicts the fin stock shown in FIG. 3 being tapered.

FIG. 7 depicts a top view of cold worked material 34', the material after being compressed by rollers 56, 58, being passed through a pair of tapering rollers 56', 58'.

Tapered rollers 56', 58' compress outer edge 35 of material 34' and leaves inner edge 37 untouched. By doing this, material 34' exiting tapered rollers 56', 58' form into a natural helix where inner edge 37 is the part of the helix that comes in contact with tube 12 and the compressed outer edge 35 has sufficient material, due to the tapering, to be wound about tube 12 at a distance further away than inner edge 37.

What is claimed is:

1. A fin stock, comprising:

a cold worked aluminum based material that is shaped into a helix;

said cold worked material has a tensile strength of between approximately 14,000 and approximately 26,000 psi;

said cold worked material has an elongation of less than approximately 10%; and said cold worked material has a hardness of between approximately 50 and approximately 70 on a Rockwell 15T scale.

2. The fin stock according to claim 1, wherein said tensile strength is between approximately 3000 psi and approximately 6000 psi greater than fully annealed aluminum.

3. The fin stock according to claim 1, wherein said elongation is between approximately 1% and approximately 2%.

4. The fin stock according to claim 1, said material has a thickness of between approximately 0.014 gauge and approximately 0.020 gauge.

5. The fin stock according to claim 1, further comprising a yield strength of between approximately 17,000 psi and approximately 25,000 psi.

6. A heat exchanger, comprising:

a tube for transporting a gas or liquid;

said gas or liquid having a temperature;

a fin stock in contact with said tube for dispersing the temperature of said gas or liquid;

said fin stock being cold worked aluminum that is helically wound about said tube;

said fin stock has a tensile strength of between approximately 14,000 and approximately 26,000 psi;

said fin stock has an elongation of less than approximately 2% and a thickness between approximately 0.014 gauge and approximately 0.020 gauge; and said fin stock has a hardness of between approximately 50 and approximately 70 on a Rockwell 15T scale.

7. The heat exchanger according to claim 6, wherein said fin stock is cold worked without annealing.

8. The heat exchanger according to claim 6, wherein said elongation is between approximately 1% and approximately 2%.

9. The heat exchanger according to claim 6, wherein said fin stock has a yield strength of between approximately 17,000 psi and approximately 25,000 psi.

10. A fin stock, comprising:

A cold worked material having at least 99% aluminum;

said cold worked material is shaped into a helix;

said cold worked material has a tensile strength of between approximately 18,000 and approximately 20,000 psi;

said cold worked material has an elongation of less than 10%; and said cold worked material has a hardness of between approximately 50 and approximately 70 on a Rockwell 15T scale.

11. The fin stock according to claim 10, wherein said cold worked material has a thickness between approximately 0.014 gauge and 0.020 gauge.

12. The fin stock according to claim 10, wherein said cold worked material has a thickness between approximately 0.014 gauge and approximately 0.017 gauge.

* * * * *